US008827505B1

(12) United States Patent
Senkyr et al.

(10) Patent No.: US 8,827,505 B1
(45) Date of Patent: Sep. 9, 2014

(54) LIGHTING FIXTURE WITH CLIP-CONNECT DIFFUSER BASE AND SELF-RETAINING FLEXIBLE DIFFUSER

(75) Inventors: Keith A. Senkyr, Elkton, KY (US); Stewart B. Lewis, Dunwoody, GA (US)

(73) Assignee: RLR Industries, Inc., Mableton, GA (US)

( * ) Notice: Subject to any disclaimer, the term of this patent is extended or adjusted under 35 U.S.C. 154(b) by 147 days.

(21) Appl. No.: 13/463,897

(22) Filed: May 4, 2012

Related U.S. Application Data

(60) Provisional application No. 61/485,667, filed on May 13, 2011.

(51) Int. Cl.
*F21V 11/00* (2006.01)

(52) U.S. Cl.
USPC ..... 362/351

(58) Field of Classification Search
USPC ..... 362/140, 146, 147, 235, 240–248, 362/249.01, 249.02, 249.16, 276–278, 362/296.01, 296.02, 307, 310, 317, 320, 362/323, 326, 327, 351, 35, 5, 363, 374, 362/375, 641, 644, 652–654, 656, 800, 802, 362/806; 40/541, 542, 554, 564, 574, 575
See application file for complete search history.

(56) References Cited

U.S. PATENT DOCUMENTS

| | | | | | |
|---|---|---|---|---|---|
| 3,142,445 | A | * | 7/1964 | Jones | 362/311.06 |
| 3,185,835 | A | * | 5/1965 | Muller et al. | 362/324 |
| 3,381,126 | A | * | 4/1968 | Steiner | 362/368 |
| 4,032,774 | A | * | 6/1977 | Spicer | 362/382 |
| 4,088,881 | A | | 5/1978 | Neer et al. | |
| 4,546,419 | A | * | 10/1985 | Johnson | 362/95 |
| 4,694,285 | A | * | 9/1987 | Scripps | 340/693.2 |
| 4,915,638 | A | * | 4/1990 | Domian | 439/142 |
| 5,006,968 | A | * | 4/1991 | Miller | 362/147 |
| 5,165,780 | A | * | 11/1992 | Katz | 362/147 |
| 5,228,584 | A | * | 7/1993 | Williams, Jr. | 220/3.8 |
| D341,901 | S | * | 11/1993 | Monaghan | D26/87 |
| 5,297,011 | A | | 3/1994 | Triunfol | |
| 5,379,199 | A | * | 1/1995 | Hirshenhorn et al. | 362/147 |
| 5,381,320 | A | * | 1/1995 | Jordan | 362/147 |
| D397,489 | S | * | 8/1998 | Alexander | D26/118 |
| 6,132,070 | A | * | 10/2000 | Vosika et al. | 362/368 |
| D590,088 | S | * | 4/2009 | Dworschak | D26/85 |
| 7,568,829 | B2 | * | 8/2009 | Chien | 362/641 |
| 7,758,234 | B1 | * | 7/2010 | Savicki et al. | 362/641 |
| D638,977 | S | * | 5/2011 | Heyrman | D26/85 |
| D681,255 | S | * | 4/2013 | Bickler et al. | D26/87 |
| 8,529,110 | B2 | * | 9/2013 | Tsukamoto | 362/544 |

* cited by examiner

*Primary Examiner* — Hargobind S Sawhney
(74) *Attorney, Agent, or Firm* — Gardner Groff Greenwald & Villanueva, PC

(57) ABSTRACT

A lighting fixture includes a fixture base for mounting to a junction box, wall or other support, a trim base for attachment to the fixture base using a clip connection not requiring tools for installation, and a flexible diffuser retained under its own resilience by engagement with the trim base.

19 Claims, 7 Drawing Sheets

LIGHTING FIXTURE WITH CLIP-CONNECT DIFFUSER BASE AND SELF-RETAINING FLEXIBLE DIFFUSER

CROSS-REFERENCE TO RELATED APPLICATION

This application claims the priority benefit of U.S. Provisional Patent Application Ser. No. 61/485,667, filed May 13, 2011, the entirety of which is hereby incorporated herein by reference.

TECHNICAL FIELD

The present invention relates generally to the field of lighting fixtures, and more particularly to a lighting fixture having a diffuser base affixed by a clip or snap connection and a flexible self-retaining diffuser.

BACKGROUND

Various forms of lighting fixtures and decorative displays are known. For example, lamps, wall sconces and pendant mounted ceiling lights, lighted signs, and various other devices have been provided. Continued improvement in the field and new product alternatives are sought.

SUMMARY

The present invention provides improvements to lighting fixtures and lighting diffusers. In example embodiments, the present invention provides an easy to install lighting fixture having a diffuser base that may be installed without tools using a snap or clip connection to the fixture base. A flexible, self-retaining diffuser is easily mounted to the diffuser base, also without need for tools. In this manner, the fixture enables assembly and installation by the consumer, and/or allows for interchangeability of different decorative diffuser materials onto the fixture.

The flexible diffuser material allows the fixture to be shipped and/or stored in compact packaging, for example by packaging the diffuser in a flat or tightly rolled state, and be flexed into the desired end state by the consumer upon installation. Various decorative applications and differing diffuser geometries are within the scope of the invention, example embodiments of which are shown and described. The invention is applicable to a variety of lighting fixture types, including without limitation, lamps and wall sconces, vanity fixtures, ceiling fixtures, and other formats.

In one aspect, the invention relates to a lighting fixture preferably including a fixture base having an electrical connection for an electric lamp, and at least one first retaining element. The lighting fixture preferably also includes a trim base having at least one second retaining element for cooperative engagement with the at least one first retaining element to attach the trim base to the fixture base.

In another aspect, the invention relates to a method of installation of a lighting fixture. The method preferably includes the steps of mounting a fixture base to a support structure, electrically connecting the fixture base to an electrical power source, and attaching a trim base to the fixture base.

In still another aspect, the invention relates to a lighting fixture, preferably including a trim base having first and second slots formed therein, and a diffuser having a resilient body flexible between a substantially flat configuration and a three dimensional configuration. Edges of the diffuser are preferably engagable within the first and second slots of the trim base to retain the diffuser in the three dimensional configuration. The diffuser is preferably retained in engagement with the trim base under bias resulting from the resilience of the diffuser body.

In another aspect, the invention relates to a lighting fixture preferably including a fixture base having a base plate, first and second pairs of retaining clips projecting from the base plate, and a lamp socket. The lighting fixture preferably also includes a trim base having first and second slots, first and second pairs of attachment apertures for cooperative engagement with the first and second pairs of retaining clips of the fixture base to attach the trim base to the fixture base, and a lamp socket aperture for passage of the lamp socket of the fixture base therethrough. The lighting fixture preferably also includes a resilient diffuser flexible between a substantially flat configuration and a three dimensional configuration, and having edges for engagement with the first and second slots of the trim base to retain the diffuser in the three dimensional configuration.

In another aspect, the invention relates to a lighting fixture preferably including a fixture base for attachment to a wall or other support surface or structure, the fixture base including electrical wires or other conductors for connection to an external or onboard power source, a socket or connector for a lamp or light bulb, and one or more clips or other trim mounting structures. The lighting fixture preferably further includes a trim base having clip receivers or other attachment features for cooperative engagement with the clips of the fixture base to attach the trim base to the fixture base. The lighting fixture preferably further includes a diffuser, for example a flexible diffuser sheet, for attachment to the trim base. Preferably the connection of the trim base to the fixture base and/or the connection of the diffuser to the trim base are snap fittings or otherwise tool-less single-operator hand connections.

In another aspect, the invention relates to a method of assembly of a lighting fixture comprising installing a fixture base to a support surface, mounting a trim base to the fixture base via a snap fitting or other tool-free connection, and installing a diffuser onto the trim base via a snap fitting or other tool-free connection. In one example form, the diffuser includes a flexible flat diffuser panel that is bent into a three-dimensional diffuser configuration and attached onto the trim base, whereby the resilience of the diffuser material retains its three-dimensional configuration after release.

In still another aspect, the present invention relates to a lighting assembly comprising a three-dimensional configuration formed from at least one initially flat panel of resilient flexible material. The at least one panel of resilient flexible material is deformable to take on the three-dimensional configuration and is retained on a light fixture in the three-dimensional configuration under its own resilience.

In another aspect, the invention relates to a lighting fixture comprising a base and a diffuser. The diffuser is initially flat and deformable into a three-dimensional configuration having coupling elements that align with and engage cooperating coupling elements of the base to retain the diffuser on the base in a flexed state.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
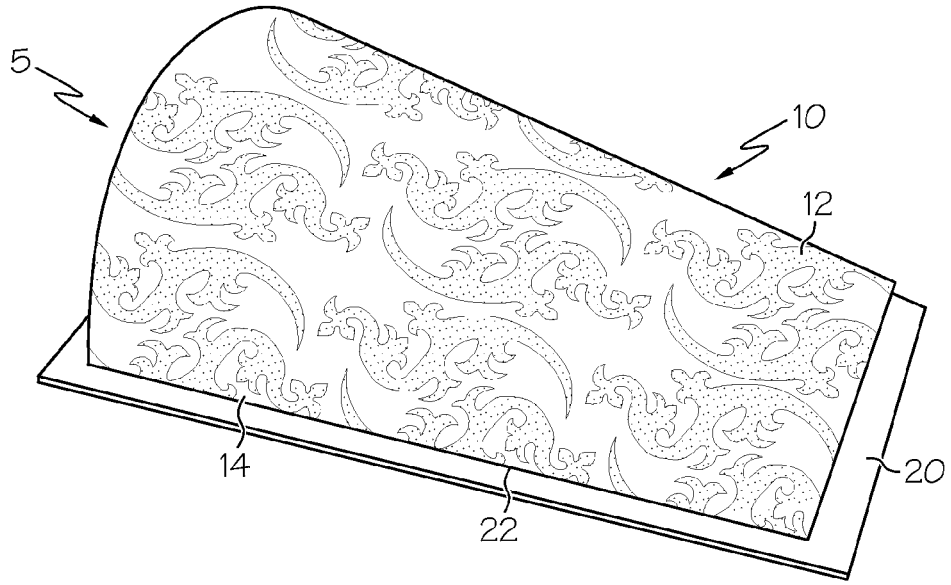
FIG. 1 is a perspective view of an assembled lighting fixture according to an example embodiment of the invention.

With reference now to the drawing figures, wherein like reference numbers represent corresponding parts throughout the several views, FIGS. 1-6 show a lighting fixture 5 according to an example embodiment of the present invention. The fixture 5 generally includes a diffuser 10, a trim base 20 and a fixture base 30. FIG. 1 shows the lighting fixture in an assembled state, wherein the trim base 20 is mounted onto the fixture base, and the diffuser 10 is mounted onto the trim base. In the depicted embodiment, the fixture is a wall sconce, wherein the fixture base 30 is configured for mounting to a wall or other support structure. In alternate embodiments, the fixture base is configured for attachment to or as part of any other lighting fixture format.

Figure 2:
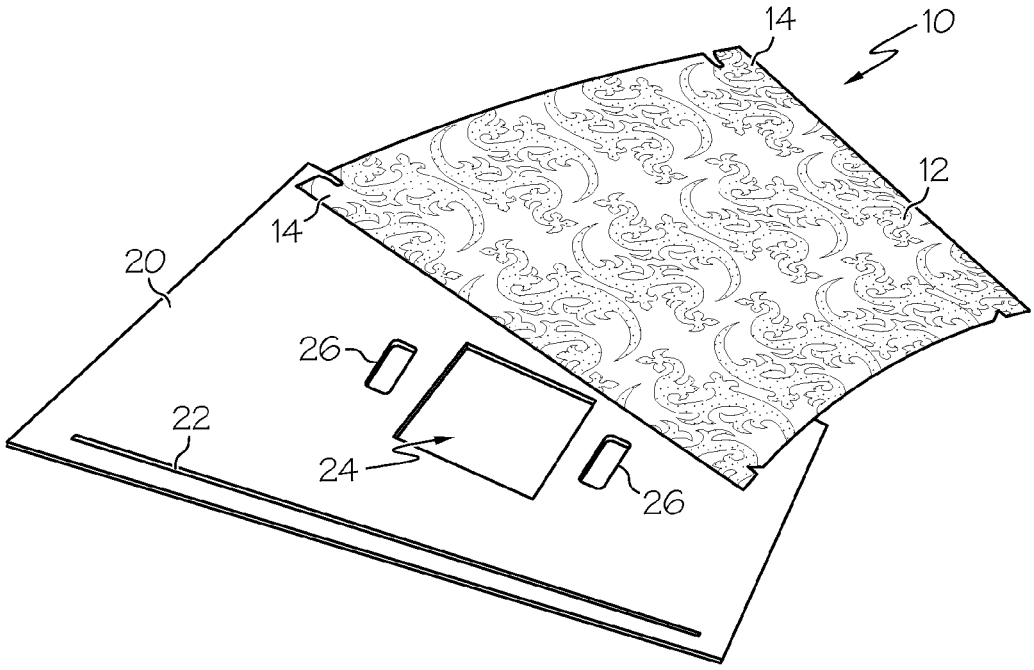
FIG. 2 shows trim base and flexible diffuser portions of the lighting fixture of FIG. 1, in a disassembled or flat configuration.

The diffuser 10 is shown in a self-retaining assembled state in FIG. 1, and in a relaxed or flattened state in FIG. 2. The diffuser 10 of the embodiment shown in FIG. 1 has a generally trapezoidal shape, with curved edges on its top and bottom sides. The top of the diffuser in the depicted embodiment has a greater radius of curvature than the bottom, forming a conic section profile. In alternate embodiments, for example as depicted in FIGS. 7-9 and 11-14, the diffuser can comprise different shapes and sizes, for various aesthetic or structural purposes to accommodate differing lighting fixture formats, as will be understood by those of skill in the art. For example, the top and bottom may comprise approximately equal radii of curvature, thereby forming a cylindrical section profile. In alternate forms, the diffuser may have one or more square, rectangular, circular, oval, flared or otherwise configured regular or irregular two-dimensional shape(s) to produce various three-dimensional forms or profiles when flexibly deformed and retained onto the fixture base as described and shown.

The diffuser 10 is generally made from a flexible, resilient panel of material that can be packaged and shipped flat, and deformed by light hand pressure into the desired three-dimensional diffuser configuration. Preferably, the diffuser is not heat formed or molded into the three-dimensional configuration, or otherwise treated to permanently deform the material, but is sufficiently flexible and resilient to hold the desired shape when assembled, retain the diffuser in place under its own resilience, and will return to a generally flat configuration if disassembled. Optionally, the diffuser can be made from a thick or thin transparent, partially opaque and/or translucent material, depending on the desired lighting effect and the fixture format to which it is to be applied. Materials such as impact grade acrylic, polycarbonate, polypropylene glycol, extruded polyethylene terephthalate, ultraviolet stabilized flexible plastic, or any other type of suitable material can be used to make the diffuser 10. The diffuser 10 can be laser cut or mechanically cut into any desired shape, or fabricated by other suitable means.

The diffuser 10 optionally comprises a material layer 12 having a decorative pattern or ornamental material layer applied thereon, and edge strips, couplings or tabs 14 for attachment of the diffuser to a base portion 20 of the fixture. Optionally, the decorative pattern or ornamental material layer comprises paper, screen prints, or laminate applied to the material layer 12 to produce various design effects. The decorative pattern or ornamental material layer is optionally positioned on the outer surface of material layer 12 of the diffuser 10, but in other embodiments, it can be positioned on the inner surface of the diffuser 10 or sandwiched between inner and outer diffuser layers. The diffuser material 12 can optionally be partially or completely colored, shaded or hued to create different lighting effects. As depicted, the edge strips or tabs 14 are located along the left and right edges of the diffuser 10, and can have the shape of notches. As depicted, the notch shape and/or size can vary and differ between each particular tab 14. The edge strips or tabs 14 are optionally stiffer or thicker than the remaining material of the diffuser 10 for additional support and attachment to the base 20.

Figure 3:
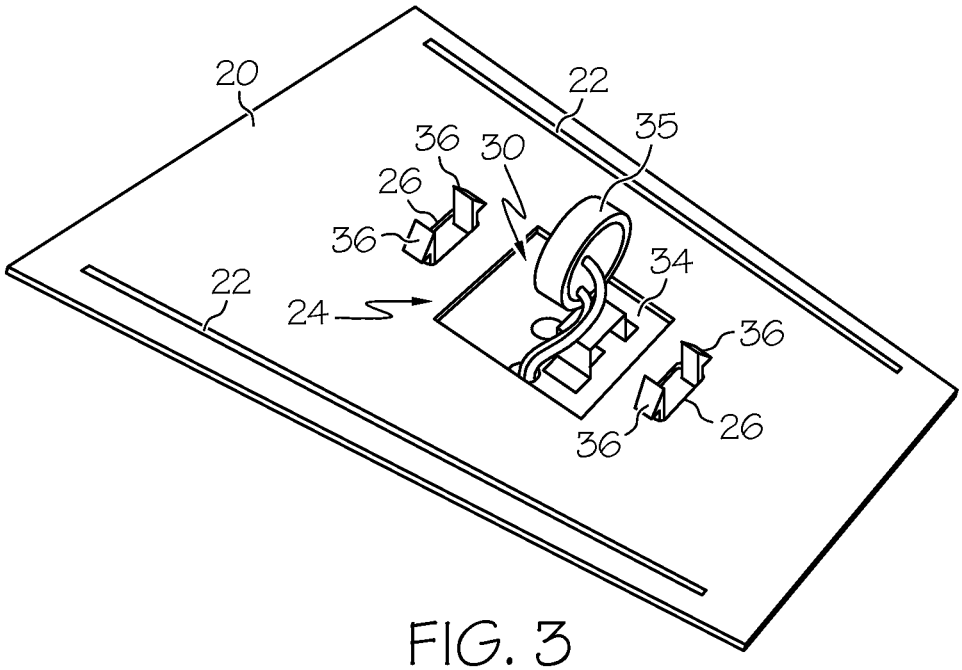
FIG. 3 shows the fixture base plate and trim base portions of the lighting fixture of FIG. 1 with a lamp socket portion of the fixture base aligned for use through an aperture of the trim base.
Figure 4:
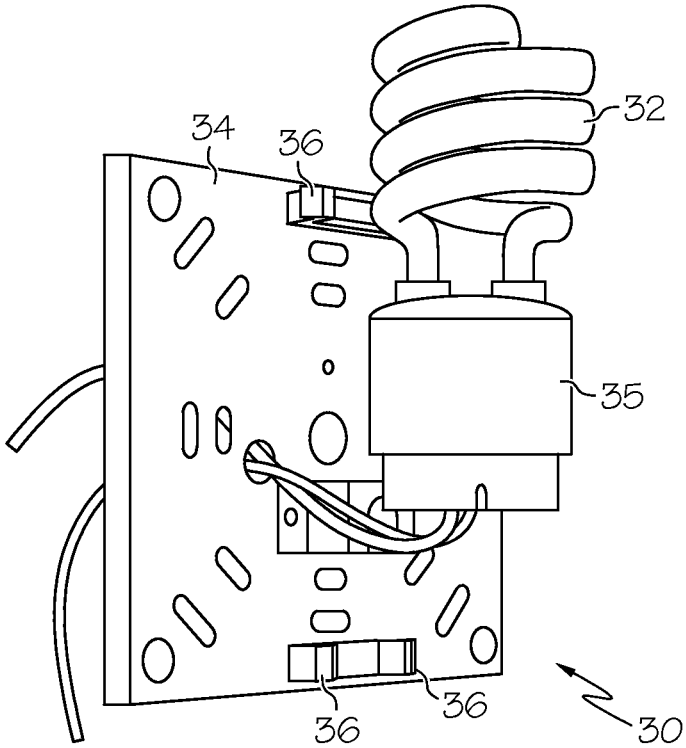
FIG. 4 shows a fixture base portion of the lighting fixture of FIG. 1.
Figure 5:
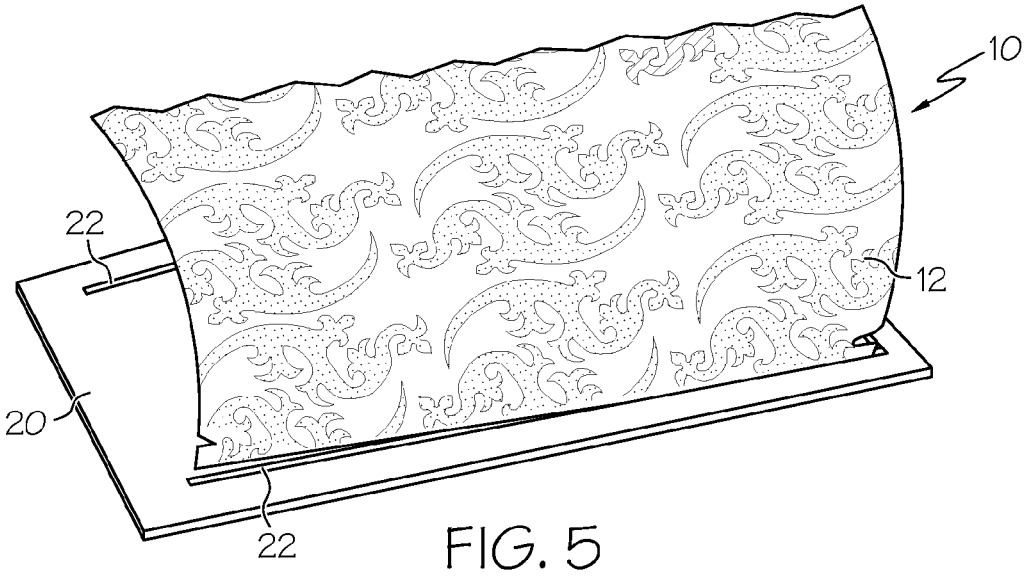
FIG. 5 shows an example method of assembly of the diffuser onto the trim base of a lighting apparatus according to an example form of the invention.

The diffuser 10 is coupled to a trim base or backer board 20 as shown in FIG. 5. As depicted in FIG. 3, the trim base or backer board 20 in this embodiment has a trapezoidal shape, generally corresponding to or complementary to the shape of the diffuser 10. The trim base or backer board 20 is preferably constructed of a substantially rigid material such as, for example, wood, plastic, composite or fiberboard. The trim base or backer board 20 can have a decorative surface or a plain surface. The trim base or backer board 20 comprises one or more channels 22 (the depicted embodiment includes two channels) or other coupling elements for attachment of the diffuser thereto, a central aperture 24, and a plurality of fixture retaining slots 26. The channels 22 are configured to receive and retain the tabs 14 of the diffuser 10. As depicted, the retaining slots 26 have an elongated shape and are positioned parallel to each other on opposite sides of the central aperture 24. The channels 22 span along and are located near the left and right side edges of the base 20. The central aperture 24 and the fixture retaining apertures 26 are located toward the center of the base 20. Optionally, alternatively-shaped fixture retaining slots can be positioned around the central aperture 24 in a generally rectangular orientation, for example a first pair of slots above the central aperture and a second pair of slots below the central aperture.

Figure 6:
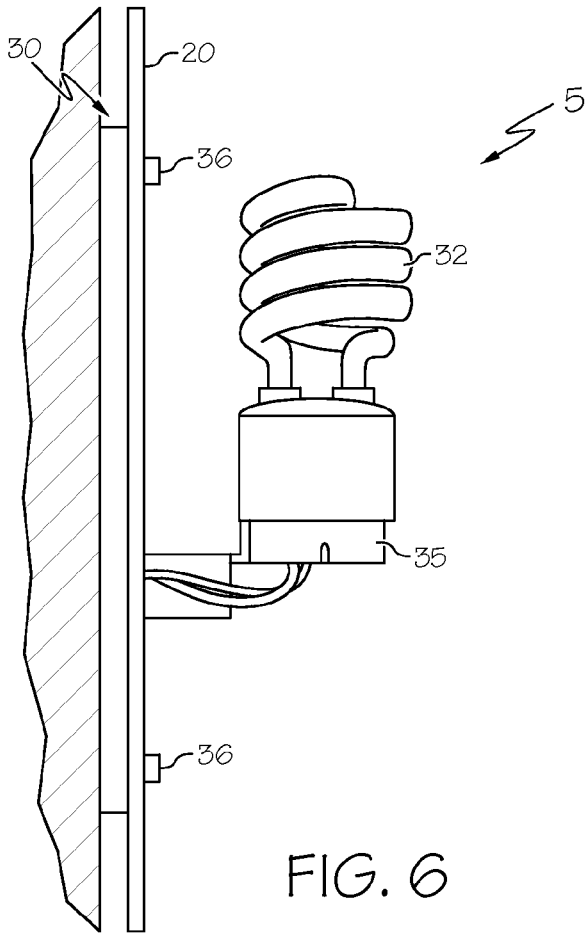
FIG. 6 shows a side sectional view of a lighting fixture according to an example form of the invention, mounted to a support surface (the diffuser omitted for clarity).

As shown in FIGS. 3 and 6, the fixture base 30 is mounted onto a wall or other support structure, and the trim base 20 is installed onto the fixture base. The fixture base 30 comprises a base plate 34 having a prewired lamp socket 35 mounted thereto for receiving a light bulb 32, as seen in further detail in FIG. 4. The fixture base is installed by connection of its wires or other electrical conductors to a power source in typical fashion, and by attaching the base plate 34 to a junction box in a wall, for example by screws, clips, or other attachment means.

The fixture base 30 comprises one or more retaining pins or attachment clips 36 protruding therefrom. The attachment clips 36 are positioned and sized for alignment and engagement within cooperating retaining slots 26 of the trim base 20. The attachment clips 36 pass through the retaining slots 26 and retain the luminaire trim base backer board in place on the fixture base plate 34. The light bulb 32 can be decoupled from the base 34 to allow the lamp socket 35 to pass through the assembly opening 24 in the trim base 20 and then be installed into the socket once assembly of the trim base and lamp socket fixture has been completed. The attachment clips 36 can be resiliently-deformable and naturally disposed at an outwardly-directed angle, thus requiring that they be deformed inwardly in order to be inserted through the retaining apertures 26. When the clips 36 pass through the apertures 26, they then naturally apply an outwardly-directed force against the apertures to secure the trim base 20 to the fixture base 30. Preferably the attachment clips 36 include one or more opposed pairs (two pairs are depicted) of resilient clip fingers extending from an integrally molded base panel, each extending through a corresponding opening in the trim base. Hooks or barbs are optionally provided on the outer or free ends of the clip fingers for retention of the trim base. As depicted, the hooks or barbs face away from each other in an opposite direction. Preferably, when the clips 36 are in a natural state the hooks or barbs will extend beyond the boundaries of the corresponding retaining slot 26 to securely but removably retain the parts together. In alternate embodiments, attachment clips extend from the trim base for engagement within retaining slots or apertures in the fixture base.

Another aspect of the invention includes a system and method for assembling a light fixture. The fixture base 30 is installed onto the intended mounting surface, such as a wall, for example via a junction box with standard electrical connections and ground wire connection. The trim base 20 is snapped onto the fixture base by engagement of the attachment clips 36 into apertures 26. Alternatively or additionally, the trim base 20 can be secured to the fixture base 30 by one or more fasteners, for example screws, to increase rigidity and strength. The lamp or bulb 32 is installed into the lamp socket 35. A flexible or rigid diffuser lens is installed onto the trim base. A variety of trim base designs can be provided with a universal attachment aperture 26 layout for attachment to a standard fixture base, and/or a variety of diffuser designs can be provided with universal attachment features for mounting to the trim base, whereby a single standard fixture base and/or trim base design can be used in connection with multiple fixture designs.

In further example method of assembly a flexible diffuser, for example as described above, is installed onto a trim base as described above by flexing the diffuser and inserting the edge strips or tabs of the diffuser into the channels of the trim base. The flexible body of the diffuser is formed of a resilient material, and is substantially flat in its unflexed or normal state (i.e., when forces are not applied to the flexible diffuser body). The body of the diffuser is flexible between the flat configuration and a three dimensional (e.g., curved, folded, radiused, angled, etc.) configuration, and the resilience of the material biases the diffuser body toward the flat configuration when in the three dimensional configuration. Once the edge strips or tabs have been inserted into the channels, the diffuser is released and holds itself in place in the three dimensional configuration due to the resilience of the material of the diffuser pressing the edges of the diffuser against the channels in an outward direction. The diffuser, trim base, and fixture base, along with connectors and other associated items, can be packaged, shipped, and purchased in a generally flat package or kit, allowing the distributor, retailer, and/or consumer to benefit from the convenience, efficiencies and/or lower cost of shipping and smaller packaging. Alternatively, the diffuser can be rolled up and packaged in a compact tightly rolled configuration, and unrolled for assembly. In alternate embodiments, the diffuser may comprise a rigid or semi-rigid diffuser lens, and/or can be attached to the trim base by one or more button connectors, push-in fasteners, tabs and slots, clips, screws, adhesive, pin and ferrule, hook and loop, or other connection means.

Figure 7:
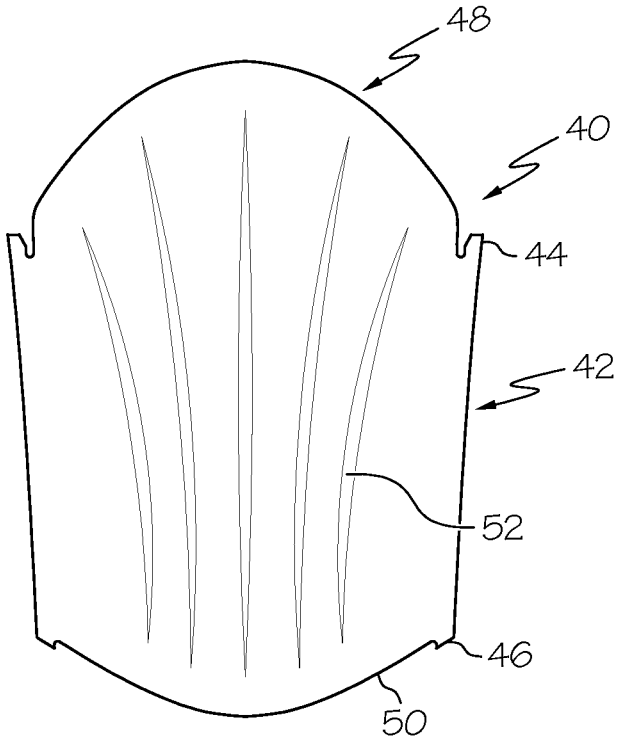
FIGS. 7-9 show alternate forms of diffuser elements.
Figure 8:
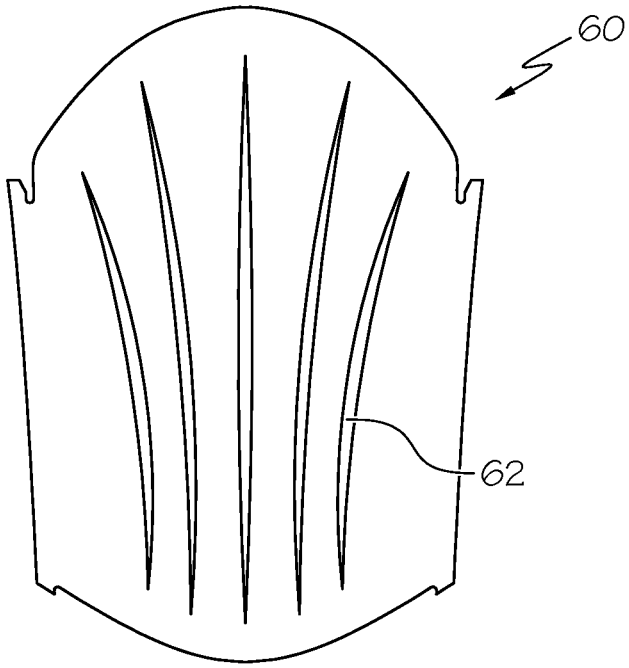
Figure 9:
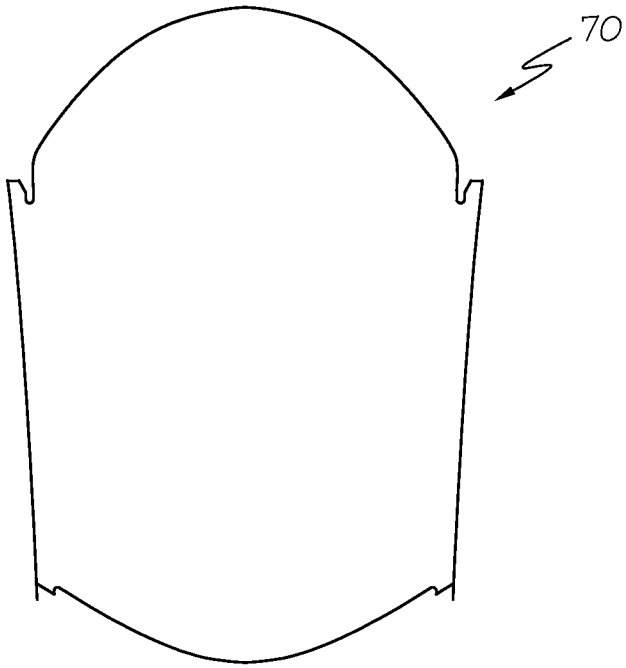

FIGS. 7-9 and 11-14 depict alternative diffuser embodiments within the scope of the invention. FIG. 7 depicts a diffuser 40 having curved upper edge 48 and lower edge 50. The diffuser 40 has right and left side edges 42. Each side edge has an upper tab 44 and lower tab 46 that include a notched section as separation from the upper and lower edges 48, 50. The diffuser 40 has a non-uniform light-transferring pattern or region 52 comprising a material thickness that is thinner or more light transmissive than the thickness of the remainder of the diffuser 40. In use, the design of the light-transferring region 52 will be illuminated by a lamp positioned behind the diffuser 40. Diffuser 60 of FIG. 8 is similar to that of FIG. 7, but with a non-uniform light transferring pattern or region 62 comprising shapes cut out from the diffuser. Diffuser 70 of FIG. 9 has a similar design with a uniform diffuser panel that does not include a non-uniform light-transferring region. In use, the diffuser 40 of FIG. 7 and the diffuser 60 of FIG. 8 can be secured to a base by themselves to allow light to freely pass through the light transmitting patterns. Preferably, in use the diffuser 40 of FIG. 7 or the diffuser 60 of FIG. 8 are sandwiched below the diffuser 70 of FIG. 9 to cover the light transmitting patterns.

Alternative diffuser embodiments are depicted in FIGS. 11-14. For example, an example diffuser 80 and the base 82 can have parallel sides and curved top and bottom edges. An alternative example diffuser 84 and base 86 can have a diamond shape. An alternative example diffuser 88 can have a crossover pattern and the base 90 can have parallel sides and curved top and bottom edges. The crossover pattern 88 can include three distinct panels. Two of the panels cross from side to side at an angle from an upper to lower position. A third panel can extend from a retaining slot along the bottom edge to a retaining slot along the top edge. An alternative example diffuser 92 can wrap around the edges of a base (not shown) so that the edges 94 can be secured underneath the base. The shapes of the light-transferring patters 52, 62 can also have different shapes than as depicted, for example circles, squares or trapezoids.

Figure 10:
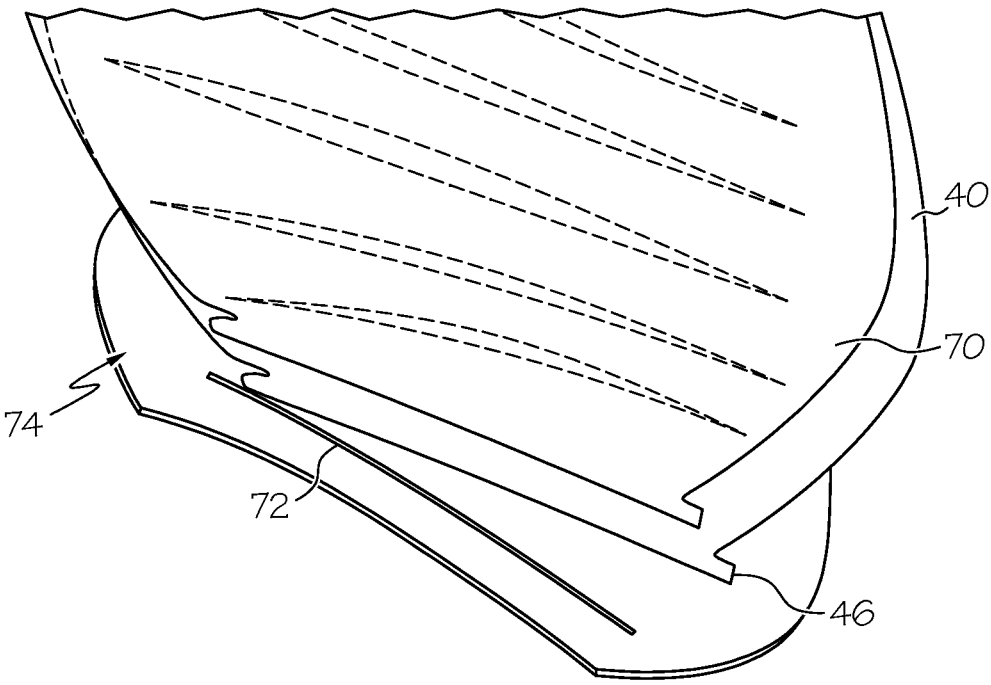
FIG. 10 shows details of the attachment of the diffuser to the trim base.
Figure 11:
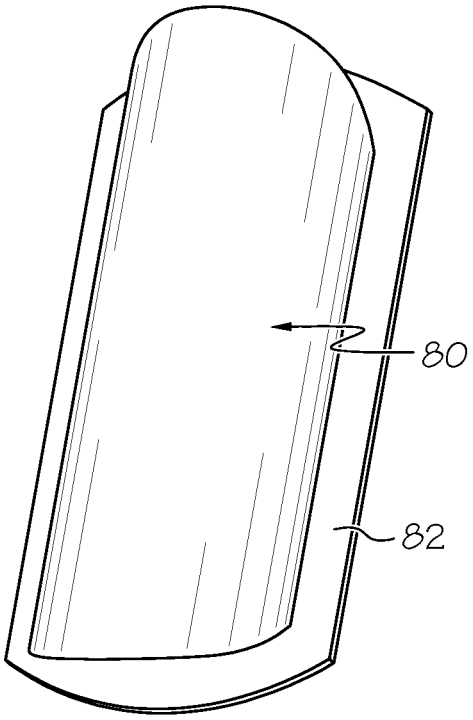
FIGS. 11-14 show alternate forms of diffuser elements.
Figure 12:
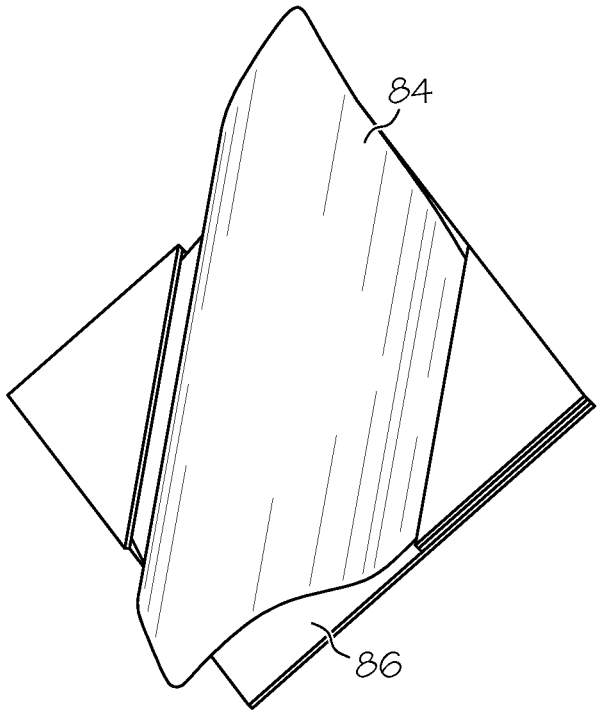
Figure 13:
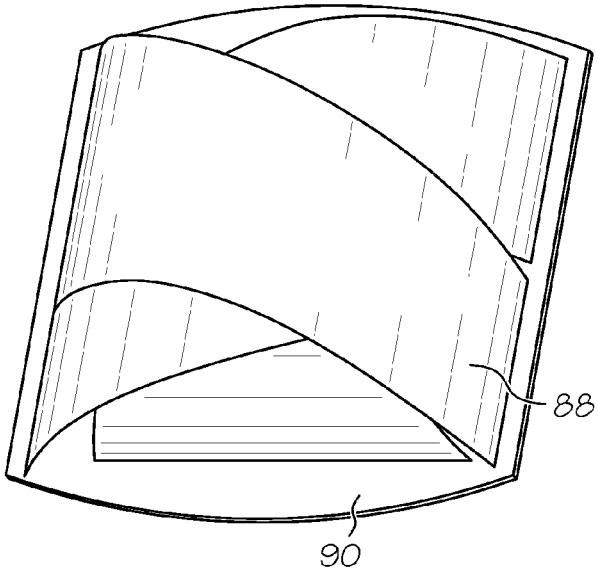
Figure 14:
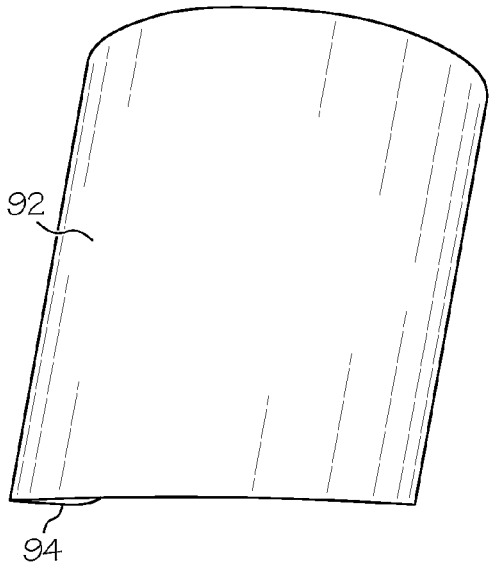

FIG. 10 depicts a method of installing the sandwiched or multi-layer diffuser into a trim base 74. As depicted, the diffuser comprises a translucent solid outer layer such as diffuser 70 described above and a perforated inner layer such as for example diffuser 40 described above, sandwiched below the outer layer. The trim base 74 includes right and left channels 72 extending through the thickness of the base that receive the corresponding side edges and tabs of the diffusers 40, 70. The length of the channels 72 is shorter than the length of the diffusers side edges. When being installed, the side edges can be inserted one tab at a time. Once all tabs on the side edges are installed in the channels 72, the notches align with the ends of the channel and prevent the diffusers 40 and 70 from accidentally dislodging from the base 74. The sandwiched layers of the diffuser can optionally comprise paper, fabric, plastic, leather, wood, metal, foils, ceramic and/or other materials of construction, and may optionally be adhered, laminated, or otherwise attached to retain the layers in place relative to one another, or can be unattached and held in place by their flexural resilience when installed.

Alternatively, the above-described diffusers can have a rigid or semi-rigid construction with a three-dimensional curved state. This alternative rigid diffuser can be constructed, for example, of glass, plastic and/or other material(s), as by extrusion, injection molding, vacuum forming, thermal forming or other fabrication methods. In use, such a diffuser can be secured to the base as described above, through screws, glue, welding, snap fittings, or other attachment means.

While the invention has been described with reference to preferred and example embodiments, it will be understood by those skilled in the art that a variety of modifications, additions and deletions are within the scope of the invention, as defined by the following claims.

What is claimed is:

1. A lighting fixture comprising:

a fixture base comprising an electrical connection for an electric lamp, and at least one first retaining element;

a trim base comprising at least one second retaining element for cooperative engagement with the at least one first retaining element to attach the trim base to the fixture base; and a diffuser for attachment to the trim base, wherein the diffuser comprises a resilient diffuser panel flexible between a substantially flat configuration and a three-dimensional configuration; wherein the trim base comprises first and second slots, and wherein the first slot receives a first edge of the resilient diffuser panel and the second slot receives a second edge of the resilient diffuser panel in its three-dimensional configuration.

2. The lighting fixture of claim 1, wherein one of the first and second retaining elements comprise an attachment clip, and wherein the other of the first and second retaining elements comprise an aperture for receiving the attachment clip.

3. The lighting fixture of claim 2, wherein one of the first and second retaining elements comprise at least one opposed pair of attachment clips, and wherein the other of the first and second retaining elements comprise a pair of apertures for receiving the opposed pair of attachment clips.

4. The lighting fixture of claim 1, wherein the first and second retaining elements are operable to engage one another upon application of hand pressure without use of tools.

5. The lighting fixture of claim 1, wherein the fixture base comprises a lamp socket for connection of the electric lamp, and wherein the trim base comprises an aperture for receiving the lamp socket upon assembly.

6. The lighting fixture of claim 1, wherein the trim base comprises first and second slots, and wherein the first slot receives a first edge of the resilient diffuser panel and the second slot receives a second edge of the resilient diffuser panel in its three-dimensional configuration.

7. A lighting fixture comprising:

a fixture base comprising an electrical connection for an electric lamp, and at least one first retaining element;

a trim base comprising at least one second retaining element for cooperative engagement with the at least one first retaining element to attach the trim base to the fixture base; and a diffuser for attachment to the trim base, wherein the diffuser comprises a non-uniform light-transferring pattern, and wherein the resilient diffuser comprises a first panel comprising a complete construction and a second panel comprising the non-uniform light-transferring pattern; and wherein the trim base comprises first and second slots, and wherein the first slot receives a first edge of the diffuser and the second slot receives a second edge of the diffuser to attach the diffuser to the trim base.

8. A lighting fixture comprising:

a fixture base comprising an electrical connection for an electric lamp, and at least one first retaining element;

a trim base comprising at least one second retaining element for cooperative engagement with the at least one first retaining element to attach the trim base to the fixture base; and a diffuser for attachment to the trim base, wherein the diffuser comprises first and second layers, the second layer arranged to at least partially overlie the first layer when attached to the trim base; and wherein the trim base comprises first and second slots, and wherein the first slot receives a first edge of the diffuser and the second slot receives a second edge of the diffuser to attach the diffuser to the trim base.

9. A method of installation of a lighting fixture, comprising:

mounting a fixture base to a support structure, and electrically connecting the fixture base to an electrical power source;

attaching a trim base to the fixture base; and attaching a diffuser to the trim base;

wherein the trim base comprises a pair of slots, wherein the diffuser comprises a flexible body having first and second sides, and wherein the diffuser is attached to the trim base by engagement of the first and second sides of the diffuser body into the slots of the trim base.

10. The method of claim 9, wherein the fixture base comprises at least one attachment clip and the trim base comprises at least one retaining aperture for cooperative engagement of the attachment clip to attach the trim base to the fixture base.

11. The method of claim 9, wherein the trim base is attached to the fixture base by hand, without use of tools.

12. A method of installation of a lighting fixture, comprising:

mounting a fixture base to a support structure, and electrically connecting the fixture base to an electrical power source;

attaching a trim base to the fixture base; and attaching a diffuser to the trim base by engagement of the diffuser into first and second slots of the trim base;

wherein the diffuser comprises first and second layers, and wherein the method further comprises arranging the second layer to at least partially overlie the first layer when attached to the trim base.

13. A lighting fixture comprising:

a trim base having first and second slots formed therein;

a diffuser comprising a resilient body flexible between a substantially flat configuration and a three dimensional configuration, wherein edges of the diffuser are engagable within the first and second slots of the trim base to retain the diffuser in the three dimensional configuration, and wherein the diffuser is retained in engagement with the trim base under bias resulting from the resilience of the diffuser body.

14. The lighting fixture of claim 13, wherein the trim base is trapezoidal and the three dimensional configuration of the diffuser comprises a conic section profile.

15. The lighting fixture of claim 13, further comprising a fixture base comprising at least one first retaining element, and wherein the trim base comprises at least one second retaining element, the first and second retaining elements configured for cooperative engagement to attach the trim base to the fixture base.

16. The lighting fixture of claim 15, wherein one of the first and second retaining elements comprise an attachment clip, and wherein the other of the first and second retaining elements comprise an aperture for receiving the attachment clip.

17. The lighting fixture of claim 15, wherein the diffuser comprises a first panel comprising a complete construction and a second panel comprising a non-uniform light-transferring pattern.

18. The lighting fixture of claim 13, further comprising a fixture base comprising at least one pair of retaining clips, and wherein the trim base comprises at least one pair of attachment apertures to receive the retaining clips and thereby attach the trim base to the fixture base.

19. A lighting fixture comprising:

a fixture base comprising a base plate, first and second pairs of retaining clips projecting from the base plate, and a lamp socket;

a trim base comprising first and second slots, first and second pairs of attachment apertures for cooperative engagement with the first and second pairs of retaining clips of the fixture base to attach the trim base to the fixture base, and a lamp socket aperture for passage of the lamp socket of the fixture base therethrough; and a resilient diffuser flexible between a substantially flat configuration and a three dimensional configuration, and having edges for engagement with the first and second slots of the trim base to retain the diffuser in the three dimensional configuration.

* * * * *